US007428806B2

(12) United States Patent
Kim

(10) Patent No.: US 7,428,806 B2
(45) Date of Patent: Sep. 30, 2008

(54) SEMI-AUTOMATIC MEDICINE PACKAGING MACHINE WITH CASSETTE LOCK UNIT

(75) Inventor: Jun Ho Kim, Daegu (KR)

(73) Assignee: JVM Co., Ltd., Taegu (KR)

( * ) Notice: Subject to any disclaimer, the term of this patent is extended or adjusted under 35 U.S.C. 154(b) by 0 days.

(21) Appl. No.: 11/764,959

(22) Filed: Jun. 19, 2007

(65) Prior Publication Data

US 2008/0173664 A1 Jul. 24, 2008

(51) Int. Cl.
*B65B 35/54* (2006.01)

(52) U.S. Cl. ..... 53/154; 53/131.5; 53/493; 221/83; 221/125; 221/154; 312/107.5; 312/218

(58) Field of Classification Search ..... 53/131.2, 53/52, 154, 168, 237, 131.4, 131.5, 493; 221/2, 9, 83, 154, 125; 312/218, 107.5
See application file for complete search history.

(56) References Cited

U.S. PATENT DOCUMENTS 4,209,211 A * 6/1980 Alford ..... 312/215
4,811,764 A * 3/1989 McLaughlin ..... 141/98
5,069,511 A * 12/1991 Swets et al. ..... 312/107.5
6,409,290 B1 * 6/2002 Lin ..... 312/219
6,722,167 B1 * 4/2004 Hsu ..... 70/78
6,772,907 B2 * 8/2004 Kim ..... 221/131
2004/0129716 A1 * 7/2004 Naufel et al. ..... 221/9
2005/0179349 A1 * 8/2005 Booth ..... 312/257.1

* cited by examiner

*Primary Examiner*—Thanh K Truong
(74) *Attorney, Agent, or Firm*—John K. Park; Park Law Firm

(57) ABSTRACT

Disclosed is a semi-automatic medicine packaging machine with cassette lock unit that improves packaging efficiency and speed by supplying an automatic supply unit and prevents an unauthorized person from supplement and outflow of tablets by fixing tablet cassettes arrayed in the automatic supply unit as a whole. The semi-automatic medicine packaging machine including a medication feed outlet that feeds and discharges medications into a hopper, a sealing unit that seals medications in the hopper by medication envelope(s), a printing unit that prints data on medication envelope(s), a controller that controls the overall apparatus, and a button operation unit that inputs a user's operation into the controller includes an upper shelf; cassette stands; an automatic supply unit including a plurality of tablet cassettes established on the upper part of the cassette stands; and a cassette lock unit that prevents separation of the tablet cassettes from the cassette stands.

5 Claims, 10 Drawing Sheets

FIG. 8 [PRIOR ART]
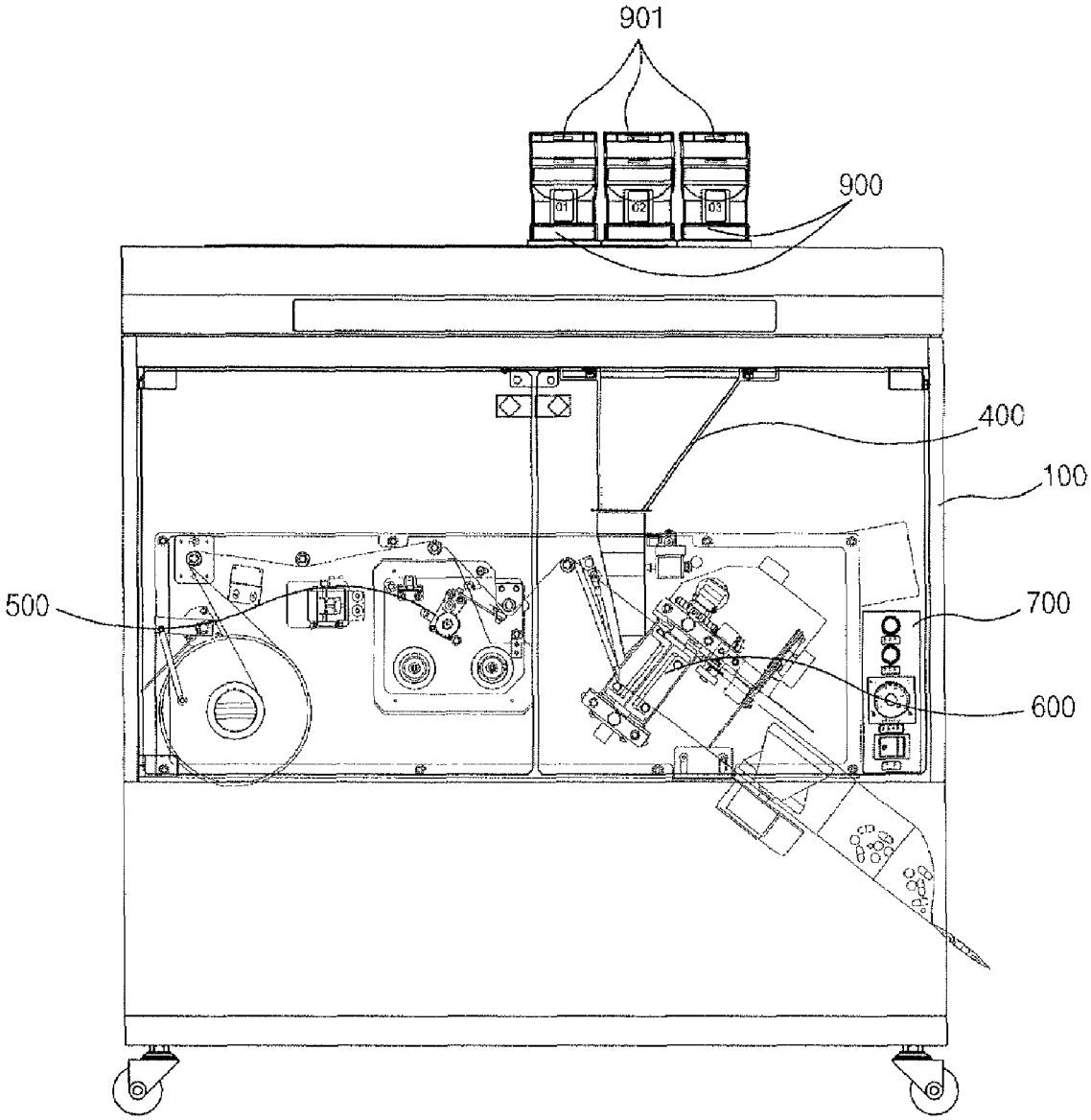

FIG. 9 [PRIOR ART]
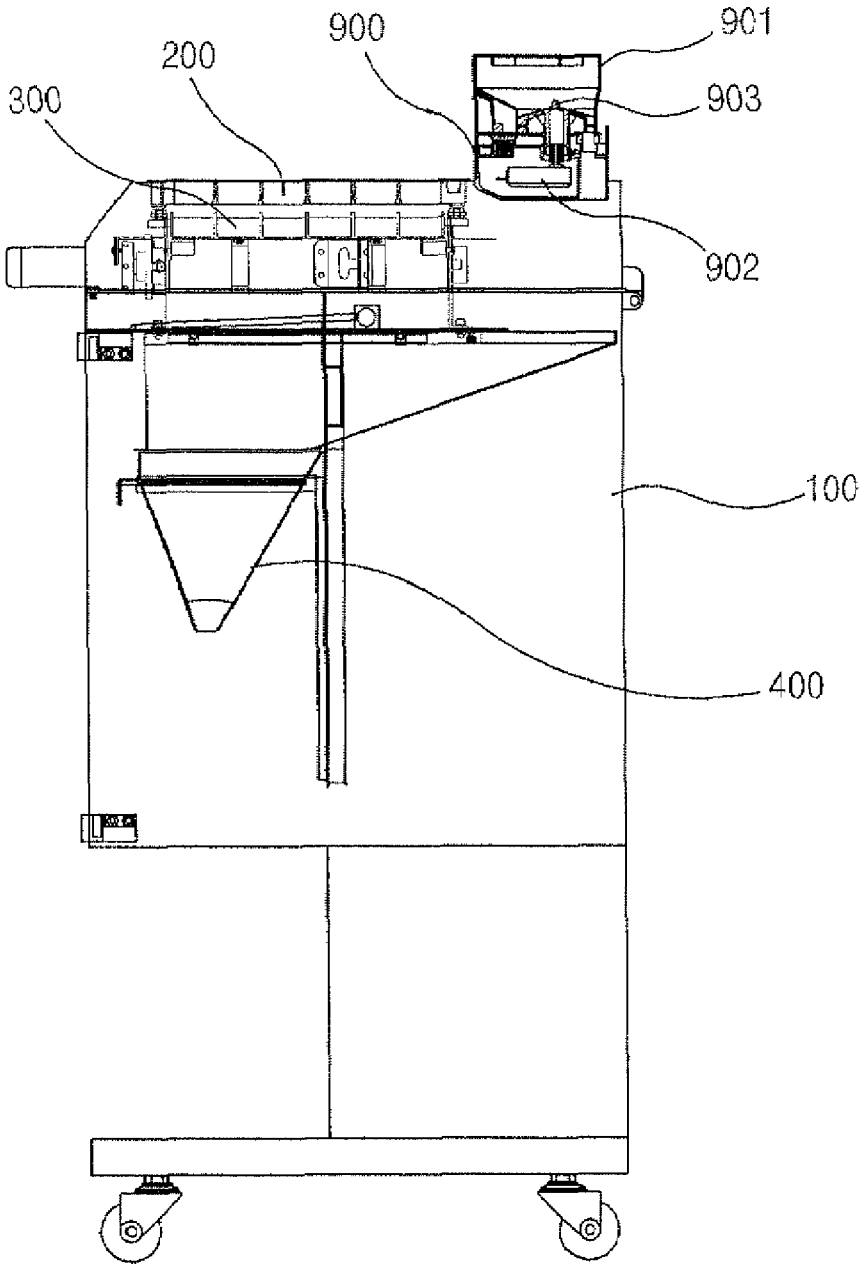

FIG. 10 [PRIOR ART]
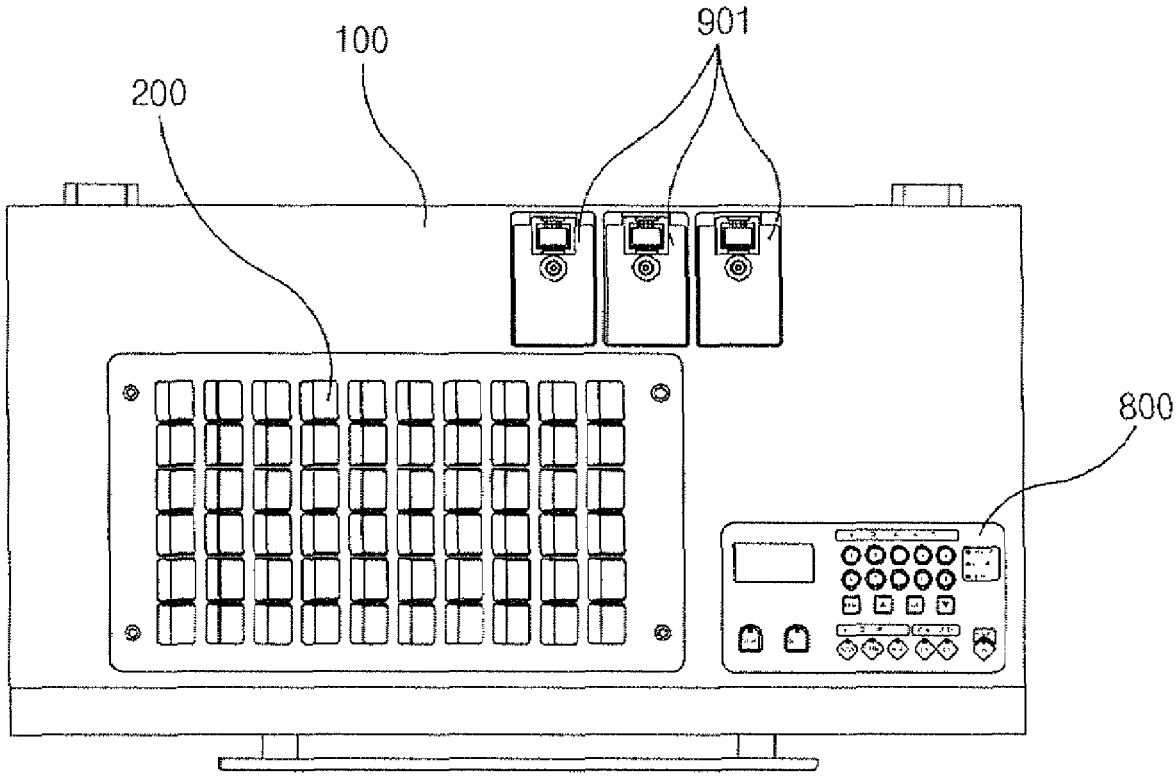

SEMI-AUTOMATIC MEDICINE PACKAGING MACHINE WITH CASSETTE LOCK UNIT

CLAIMING FOREIGN PRIORITY

The applicant claims and requests a foreign priority, through the Paris Convention for the Protection of Industrial Property, based on patent applications filed in the Republic of Korea (South Korea) with the filing date of Jan. 19, 2007 with the patent application number 10-2007-0006111 by the applicant, the contents of which are incorporated by reference into this disclosure as if fully set forth herein.

BACKGROUND OF THE INVENTION

The present invention relates to a semi-automatic medicine packaging machine that packages each dose of medication manually dispensed by a user or a pharmacist. Specifically, the present invention relates to the semi-automatic medicine packaging machine with cassette lock unit that improves packaging efficiency and speed by supplying an automatic supply unit and prevents supplement and outflow of tablets by an unauthorized person by fixing tablet cassettes arrayed in the automatic supply unit as a whole.

In general, a semi-automatic medicine packaging machine, which is provided to small pharmacies or other similar places, continuously packages each dose of tablet-type medication manually dispensed by a user or a pharmacist. In contrast to the semi-automatic medicine packaging machine, there is an automatic medicine packaging machine, which is provided to big hospitals or other similar places, that continuously packages each dose of medication through prescription data input.

Referring to FIG. 8, FIG. 9 and FIG. 10, the semi-automatic medicine packaging machine of prior art includes a medication feed outlet 300 that feeds medications dispensed into a manual dispensing tray 200 established on the upper part of a body 100 and discharges medications to a hopper 400, a sealing unit 600 that feeds and seals tablets in the hopper 400 by tablet envelope(s) on which instruction labels are printed by a printing unit 500, a controller 700 which controls the medication feed outlet 300, the printing unit 500, and the sealing unit 600, a button operation unit 800 that is established on a side of the upper part of the body 100 and inputs user's operation command into the controller 700, a plurality of cassettes stands 900 on the upper part of the body 100, and a plurality of tablet cassettes 901 on the upper part of the cassettes stands 900.

In the semi-automatic medicine packaging machine, a user or a pharmacist compounds prescription by dispensing each dose of medication into the manual dispensing tray 200, and those medications fall freely from the manual dispensing tray 200 into the medication feed outlet 300 at one time.

The each dose of medication fallen into the medication feed outlet 300 are discharged into the hopper 400 by operation of the medication feed outlet 300 which is controlled by the controller 700, and then the each dose of medication is exported to medication envelope(s), on which instructions are printed by the printing unit 500, to form a medication package by heat-sealing process of the healing unit 600.

The sequential performance of the above process makes medication packages which are manually prescription compounded by a pharmacist. The tablet cassettes 901 which is controlled by the controller 700 plays a role of discharging each tablet housed in the interior of the tablet cassettes 901 into the hopper 400. Therefore, frequently used medications may be housed in the tablet cassettes 901 and make medication packages by combining manually dispensed medications with medications in the tablet cassettes 901. Each tablet housed in the tablet cassettes 901 is discharged into the hopper 400 by being rotated by rotators 903 driven by motors 902 established in the cassettes stands 900.

However, the semi-automatic medicine packaging machine by the above prior art has a disadvantage that packaging efficiency and speed are considerably low compared to automatic medicine packaging machine because of almost manual packaging due to shortage in number of tablet cassettes established on the upper part of the body.

Another disadvantage of the semi-automatic medicine packaging machine is that the supplement or outflow of tablets may be easily done by an unauthorized person, so that tablets which have been dispensed into tablet cassettes may not be preserved safely and also the supplement of tablets may not be made exactly.

SUMMARY OF THE INVENTION

The present invention contrives to solve the above disadvantages of the prior art. An objective of the invention is to provide a semi-automatic medicine packaging machine with cassette lock unit that improves packaging efficiency and speed by supplying an automatic supply unit and prevents supplement and outflow of tablets by an unauthorized person by fixing tablet cassettes arrayed in the automatic supply unit as a whole.

Another objective of the invention is to provide a semi-automatic packaging machine with cassette lock unit that makes fixing of tablet cassettes stable and smooth regardless of separation direction of tablet cassettes which may be separated horizontally or vertically as a simple structure.

Still another objective of the invention is to provide a semi-automatic packaging machine with cassette lock unit that prevents an unauthorized person from operating the semi-automatic medicine packaging machine through user authentication.

A semi-automatic medicine packaging machine including a medication feed outlet that feeds and outlets medications into a hopper, a manual dispensing tray, a sealing unit that seals medications in the hopper by medication envelope(s), a printing unit that prints data on the medication envelope(s), a controller that controls the medication feed outlet, the printing unit, and the sealing unit, and a button operation unit that inputs user's operation to the controller includes: a shelf that has an outlet connected to the hopper; an automatic supply unit, which discharges medications into the outlet according to the operation of the controller, including a plurality of cassette stands arrayed in the interior of the shelf and a plurality of tablet cassettes detachably established on the upper part of the cassette stands for housing medications; and a cassette lock unit that is established on the shelf and prevents separation of the tablet cassettes from the cassette stands according to operation of the button operation unit.

The shelf includes a door that is established on the open front of the upper shelf.

The cassette lock unit includes one or more horizontal anchor bars established in the interior of the shelf along the upper faces of the horizontally arrayed tablet cassettes, one or more vertical moving bars established as vertically movable in the interior of the shelf and are vertically attached to the sides of the horizontal anchor bars, and a lift driver that is controlled by the controller and makes the vertical moving bars vertically moved by having the horizontal anchor bars' having close contact with the upper surfaces of the tablet cassettes to prevent vertical separation of the tablet cassettes.

The cassette lock unit further includes a horizontal separation bump that is attached to the horizontal anchor bar and being in close contact with the front faces of the tablet cassettes to prevent horizontal separation of the tablet cassettes.

The cassette lock unit further includes a guide unit that is established in the interior of the shelf and guides vertical moving of the vertical moving bars.

The guide unit includes one or more sliding tubes established on the vertical moving bars and one or more vertical guide shafts inserted into the sliding tubes and have the upper and lower parts established in the interior of the shelf.

The lift driver includes an upper frame that has a horizontal slot, in which upper parts of the vertical moving bars are attached to the sides of the upper frame, a roller that is slidably inserted to the horizontal slot, a disk on which the roller is eccentrically attached, and a motor that is established on the shelf, controlled by the controller, and makes the disk rotate.

The semi-automatic medicine packaging machine further includes a user information input unit that is established on the exterior of the body and inputs user information into the controller for accomplishing user authentication by the controller.

The user information input unit includes a card reader that is established on the front of the body and inputs user's card information into the controller.

An advantageous effect of the present invention is that a semi-automatic medicine packaging machine with cassette lock unit improves packaging efficiency and speed by supplying an automatic supply unit and prevents supplement and outflow of tablets by an unauthorized person by fixing tablet cassettes arrayed in the automatic supply unit as a whole.

Another advantageous effect of the invention is that a semi-automatic packaging machine with cassette lock unit makes manufacture and installation of cassette lock unit convenient and also does fixing of tablet cassettes stable and smooth regardless of separation direction of tablet cassettes which may be separated horizontally or vertically as a simple structure.

Still another advantageous effect of the invention is that a semi-automatic packaging machine with cassette lock unit prevents an unauthorized person from operating the semi-automatic medicine packaging machine through user authentication and that fixing and unfixing of tablet cassettes may be done only by an authorized person to accomplish managing and handling of tablet cassettes safer.

BRIEF DESCRIPTION OF THE DRAWINGS

These and other features, aspects and advantages of the present invention will become better understood with reference to the accompanying drawings, wherein:

FIG. 8 is an elevation view of a semi-automatic medicine packaging machine by prior art.

FIG. 9 is a side elevation view of the semi-automatic medicine packaging machine by prior art.

FIG. 10 is a plan view of the semi-automatic medicine packaging machine by prior art.

DETAILED DESCRIPTION OF THE PREFERRED EMBODIMENT

Figure 1:
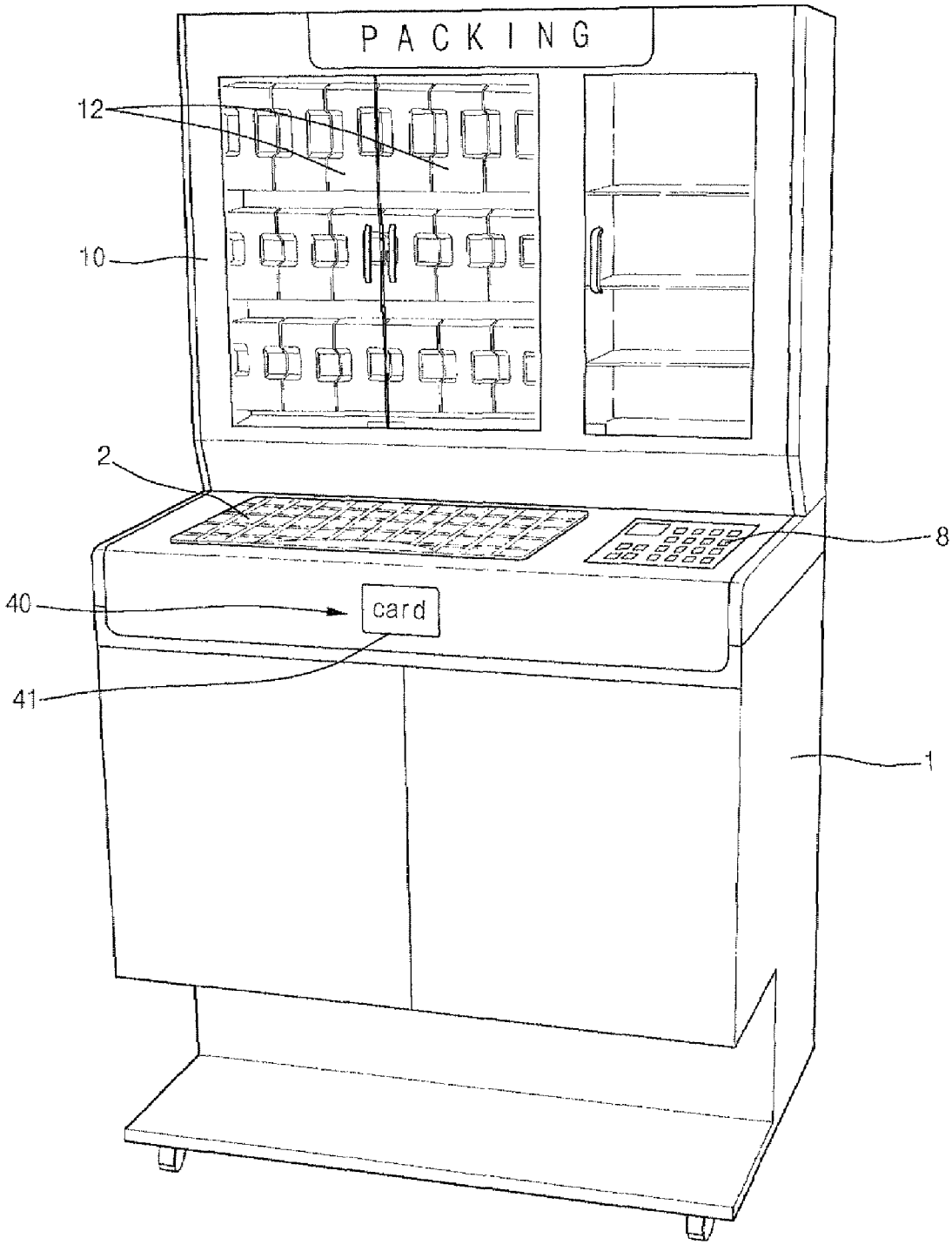
FIG. 1 is a perspective view of a semi-automatic medicine packaging machine with cassette lock unit according to the present invention.
Figure 2:
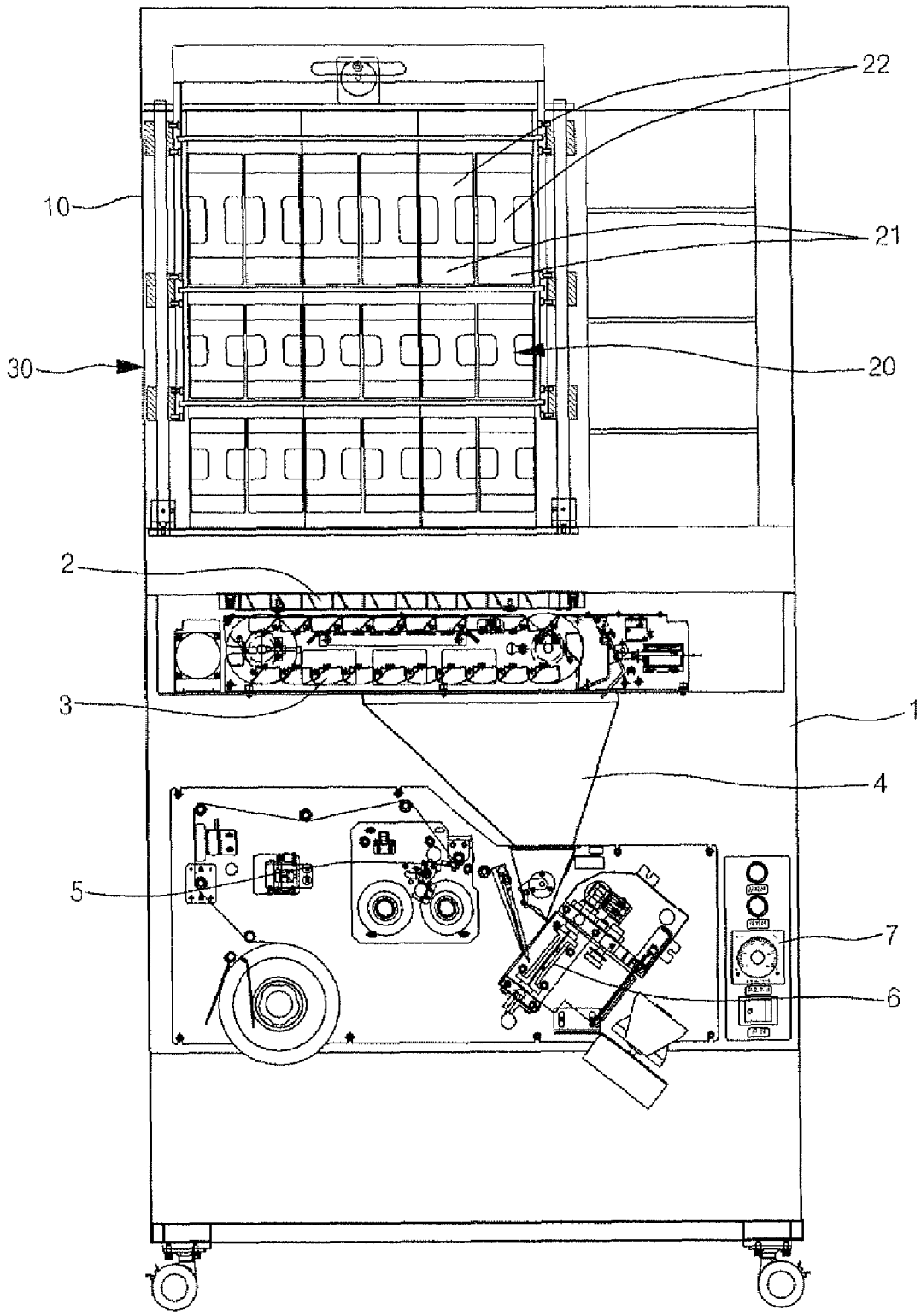
FIG. 2 is an elevation view of the semi-automatic medicine packaging machine.

Referring to FIG. 1, FIG. 2, FIG. 3, and FIG. 4, a semi-automatic medicine packaging machine includes a medication feed outlet 3 that feeds and discharges medications into a hopper 4, a manual dispensing tray 2, into which medications are dispensed, established on the upper part of a body 1, a sealing unit 6 that seals tablets in the hopper 4 with medication envelope(s) on which instruction labels are printed by a printing unit 5, a controller 7 that controls the medication feed outlet 3, the printing unit 5 and the sealing unit 6, and a button operation unit 8 that is established on a side of the upper part of the body 1 and inputs a user's operation into the controller 7.

The semi-automatic medicine packaging machine further includes an upper shelf 10 that is established on the rear upper part of the body 1, an automatic supply unit 20 that has tablet cassettes 22 that are arrayed in the interior of the upper shelf 10, and a cassette lock unit 30 that fixes or unfixes the tablet cassettes 22 as a whole.

Figure 4:
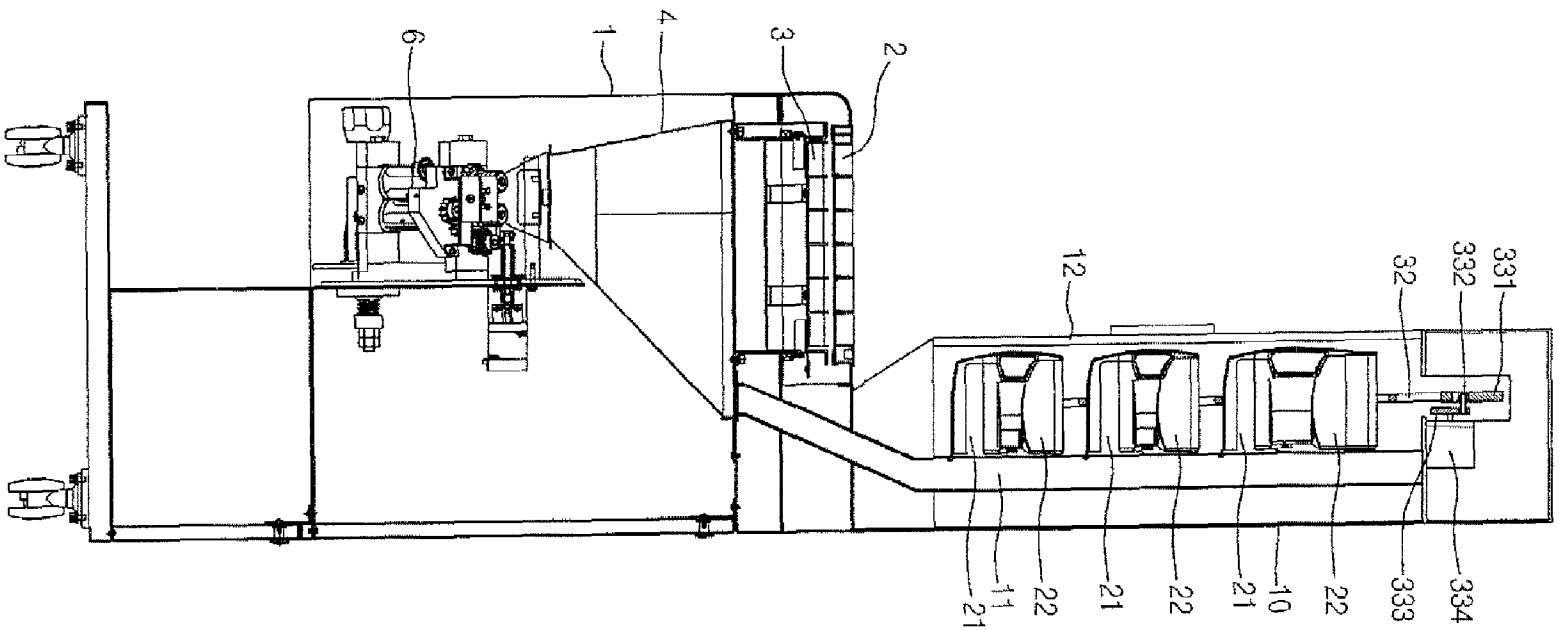
FIG. 4 is a side elevation view of the semi-automatic medicine packaging machine.

FIG. 4 shows that the upper shelf 10 has an outlet 11 rearwards connected to the hopper 4 for playing a role of supplying a space that the automatic supply unit 20 is installed in the interior of the upper shelf 10. The outlet 12 is for letting tablets released from the automatic supply unit 20 fall freely to the hopper 4.

The upper shelf 10 further has a glass door 12 that is established on the open front of the body 1 for opening or closing the front of the body 1. The glass door plays a role of reducing influx of dusts or foreign materials into the interior of the upper shelf 10.

The automatic supply unit 20 discharges tablets to the outlet 11 of the upper shelf 10 according to the control of the controller 7 and includes a plurality of cassette stands 21 arrayed in the interior of the upper shelf 10 and a plurality of tablet cassettes 22 detachably established on the upper part of the cassette stands 21 for housing medications.

The cassette stand 21 plays a role of supporting the tablet cassette arrayed on the upper part of the cassettes stand 21 and of discharging each tablet housed in the interior of the tablet cassette 22 by rotating a rotator established in the interior of the tablet cassette 22 through a built-in motor.

The cassette lock unit 30 that is established on the upper shelf 10 plays a role of preventing separation of the tablet cassettes 22 from cassette stands 21 by fixing the tablet cassettes as a whole according to operational command inputted from the button operation unit 8.

Figure 3:
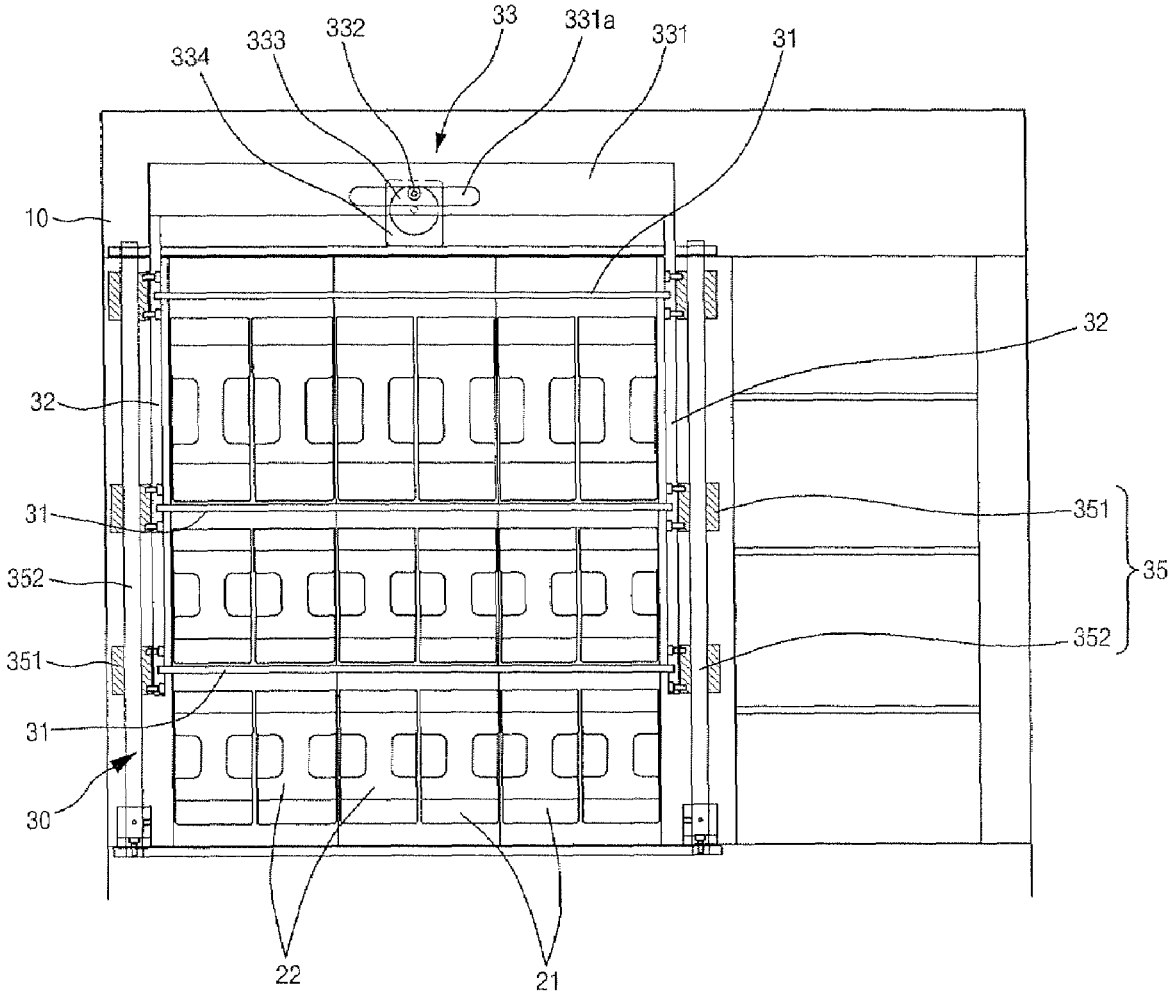
FIG. 3 is an enlarged partial elevation view of the semi-automatic medicine packaging machine.

Referring to FIG. 3, the cassette lock unit 30 includes a plurality of horizontal anchor bars 31 established in the interior of the upper shelf 10 along the upper faces of the horizontally arrayed tablet cassettes 22, a pair of vertical moving bars 32 that are established as vertically movable in the interior of the upper shelf 10 and are vertically attached to the sides of the horizontal anchor bars 31, and a lift driver 33 that is controlled by the controller and makes the vertical moving bars 32 vertically moved by the horizontal anchor bars' 31 having close contact with the upper surfaces of the tablet cassettes 22 to prevent vertical separation of the tablet cassettes 22.

The horizontal anchor bars 31 closely contact upper surface of the tablet cassettes 22 that are horizontally arrayed in the interior of the upper shelf 10 and prevent vertical separation of the tablet cassettes 22 from the cassette stands 21 because the tablet cassettes 22 may not be manually vertically moved up from the tablet stands 21. In other words, the horizontal anchor bars 31 play a role of fixing or unfixing the tablet cassettes 22 as a whole which are separated or assembled from the cassette stands 21 in vertical directions, so that the horizontal anchor bars 31 prevent supplement or outflow of tablets from the tablet cassettes 22 by an unauthorized user.

The vertical moving bars 32 play a role of ascending or descending a plurality of horizontal anchor bars 31 as a whole.

The lift driver 33 plays a role of lifting up or down the vertical moving bars 32. Referring to FIGS. 3 and 4, the lift driver 33 includes an upper frame 331 that has a horizontal slot 331*a* at the center, a roller 332 that is slidably inserted into the horizontal slot 331*a*, a disk 333 on which the roller 332 is eccentrically attached, and a motor 334 that is established on the upper shelf 10, controlled by the controller 7, and makes the disk 333 rotate. The upper parts of the vertical moving bars 32 are attached to the sides of the upper frame 331.

The upper frame 331 plays a role of lifting up or down a pair of vertical moving bars 32 simultaneously while the upper frame 331 is being lifted up or down by rotation of the roller 332 inserted into the horizontal slot 331*a*.

The roller 332 is eccentrically attached to the disk 333 which is rotating by the motor 334 and plays a role of lifting up or down the upper frame 331 while being rotated by rotation of the disk 333.

Referring to FIG. 3, the cassette lock unit 30 further includes a guide unit 35 that is established on the interior of the upper shelf 10 and guides vertical moving of the vertical moving bars 32. The guide unit 35 plays a role of improving precision of vertical moving of the horizontal anchor bars 31 by the vertical moving bars 32 by guiding vertical moving of the vertical moving bars 32.

The guide unit 35 includes a plurality of sliding tubes 351 established on the vertical moving bars 32 and a pair of vertical guide shafts 352 that are slidably inserted into the sliding tubes 351 and have upper and lower ends established in the interior of the upper shelf 10. The guide unit 35 guides vertical moving of the vertical moving bars 32 by vertical sliding of the sliding tubes 351 along the vertical guide shafts 352 fixed in the interior of the upper shelf 10 according to vertical moving of the vertical moving bars 32.

The semi-automatic medicine packaging machine further includes a user information input unit 40 that is established on the exterior of the body 1 and inputs user information into the controller 7 for accomplishing user authentication by the controller 7. The user information input unit 40 plays a role of inputting user information for user authentication into the controller 7.

The controller 7 judges whether a user is authenticated or not by comparing and analyzing user information inputted by the user information input unit 40 and user information stored in advance, lets only an authenticated user make an overall operation of the semi-automatic medicine packaging machine through the button operation unit 8, and makes operation of the cassette lock unit 30 only done by an authenticated user.

The user information input unit 40 includes a card reader 41 that is established on the front of the body 1 and inputs user's card information into the controller 7. Alternatively, a biometric identifier that recognizes a user's biometric information like a fingerprint, an iris or a voice may be used, or the button operation unit 8 may be used to input user information like personal identification numbers or passwords.

Figure 5:
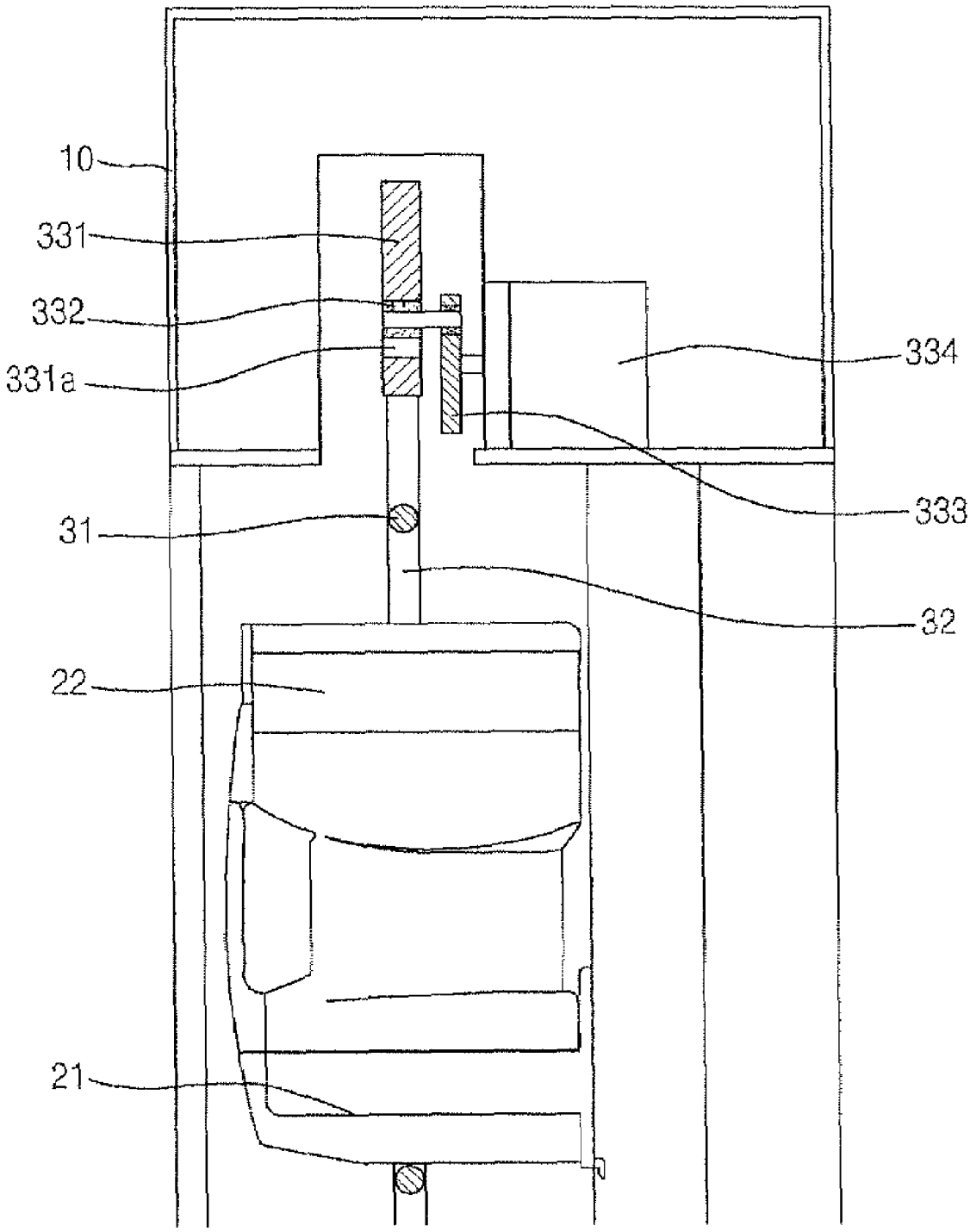
FIG. 5 is an enlarged partial side elevation view of the semi-automatic medicine packaging machine.
Figure 6:
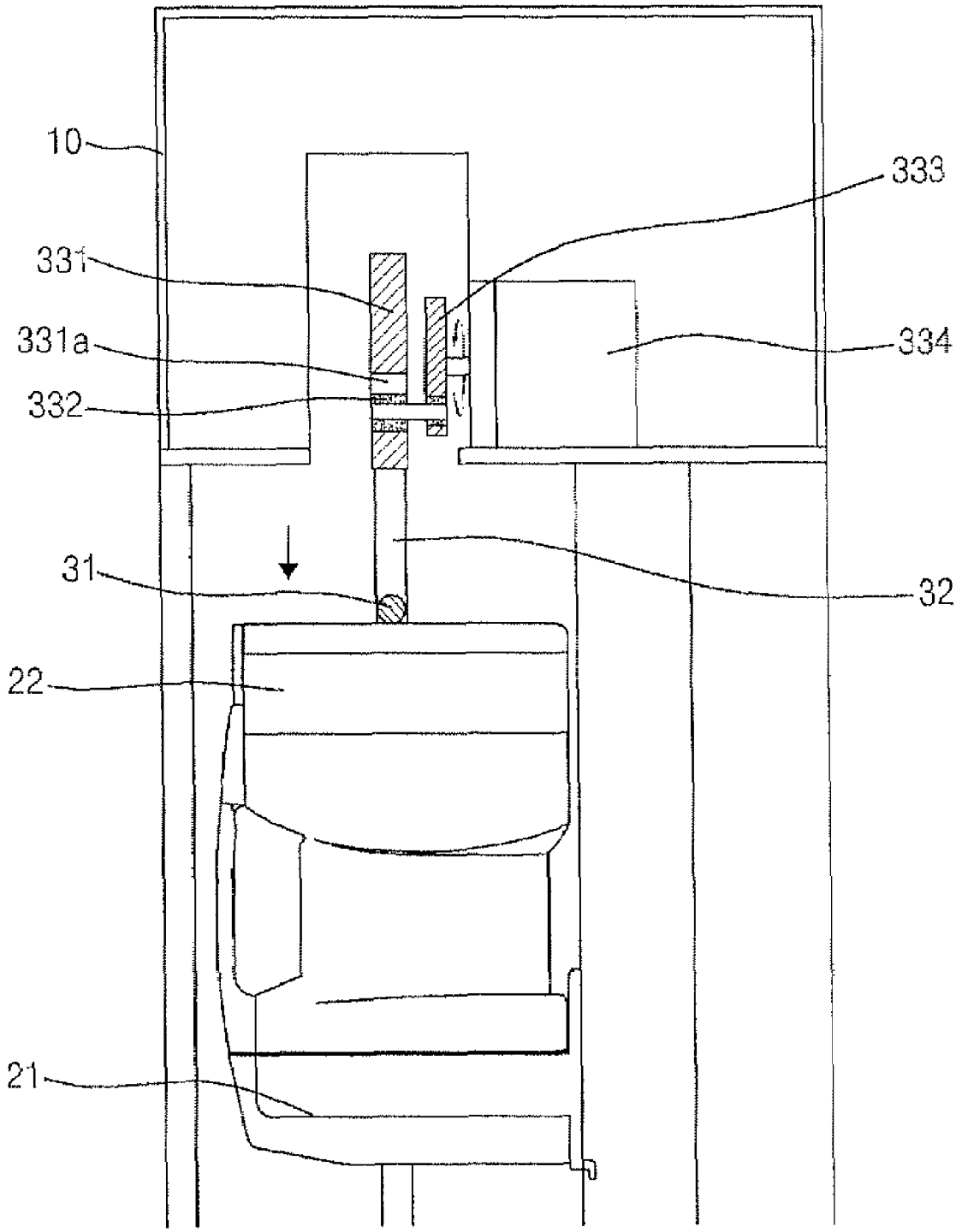
FIG. 6 is an enlarged partial side elevation view of the semi-automatic medicine packaging machine.

Referring to FIG. 5 and FIG. 6, if a user makes an operation command, the following process proceeds sequentially: the motor 334 that is established in the interior of the upper shelf 10 rotates, the disk 333 rotates, the roller 332 that is attached eccentrically to the disk 333 rotates as a state of being inserted into the horizontal slot 331*a*, the roller 332 slides along the horizontal slot 331*a*, the upper frame 331 moves downwards, a pair of vertical moving bars 32 attached to the sides of the upper frame 331 simultaneously moves downwards, the horizontal anchor bars 31 that are horizontally attached to the vertical moving bars 32 simultaneously moves downwards, and the horizontal anchor bars 31 closely contact the upper part of a plurality of the tablet cassettes 22.

Prohibition of manual vertical separation of the tablet cassettes 22 from the cassette stands 21 is facilitated as a result of the horizontal anchor bars' 31 being in close contact with the upper surface of the tablet cassettes 22 that are horizontally arrayed in the interior of the upper shelf 10. In other words, the horizontal anchor bars 31 are in close contact with the upper part of the horizontally arrayed tablet cassettes 22 while being moved down as a whole, and then vertical separation of the tablet cassettes 22 from the cassette stands 21 is prohibited because the tablet cassettes 22 may not be manually lifted up.

When vertical separation of the tablet cassettes 22 is prohibited due to close contact of the horizontal anchor bars 31, the motor 334 may be manually operated to rotate the roller 332 to original position, the horizontal anchor bars 31 are detached from the tablet cassettes 22, and then vertical separation of the tablet cassettes 22 from the cassette stands 21 is accomplished.

Figure 7:
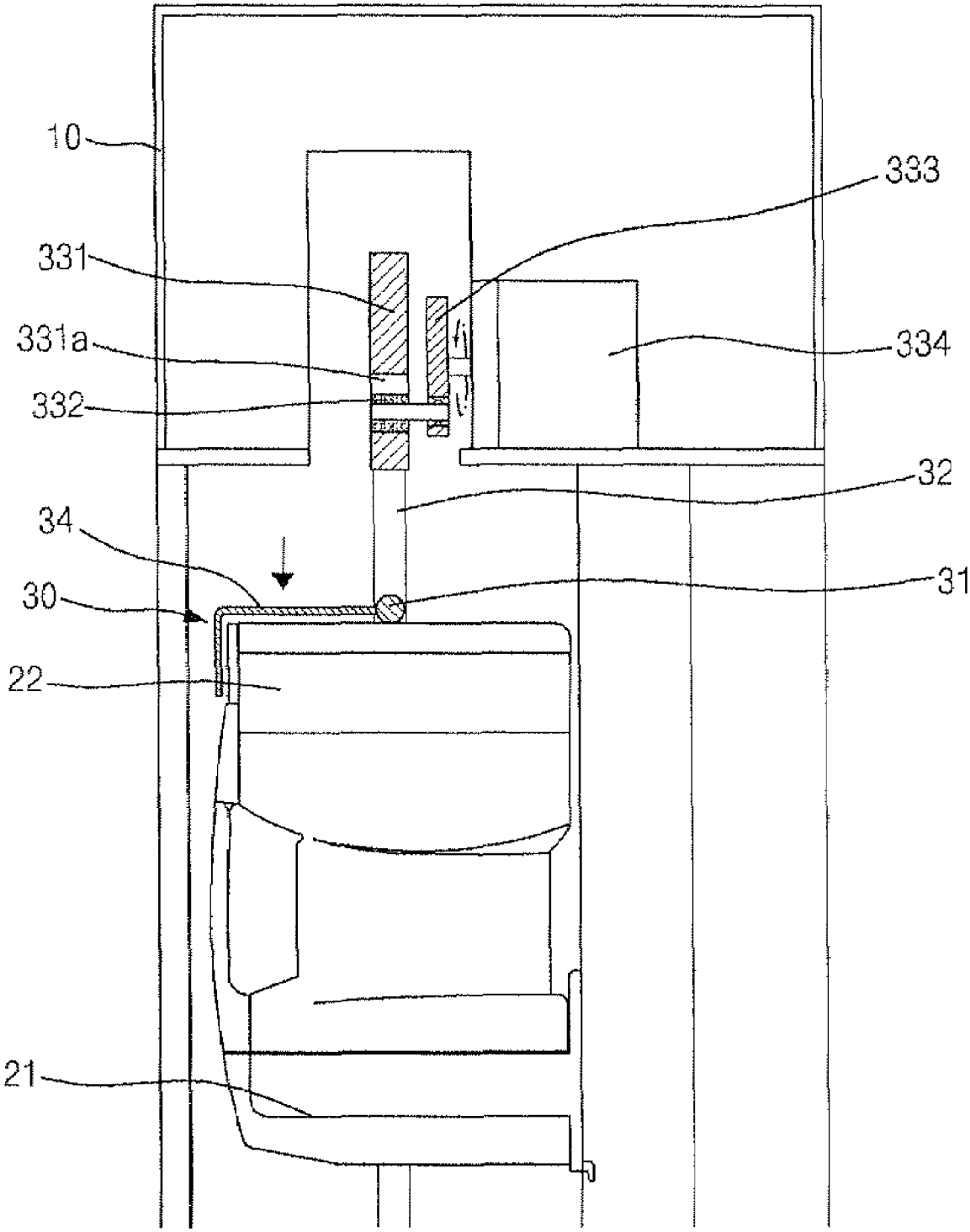
FIG. 7 is an enlarged partial side elevation view of the semi-automatic medicine packaging machine of another preferred embodiment.

Referring to FIG. 7, the cassette lock unit 30 of the semi-automatic medicine packaging machine further includes a horizontal separation bump 34 that is extended from the horizontal anchor bars 31 and in close contact with the front of the tablet cassettes 22. The horizontal separation bump 34 has a bent part that approaches to the front of the tablet cassettes 22 which are horizontally arrayed in the interior of the upper shelf 10, so that prohibition of horizontal separation of the tablet cassettes 22 from the cassette stands 21 is facilitated because the tablet cassettes 22 can not be horizontally separated from the cassette stands 21. In other words, the horizontal separation bump 34 plays a role of fixing or unfixing the tablet cassettes 22 as a whole which are separated or assembled in the horizontal direction from the cassettes stands 21.

If a user makes an operation command, the following process proceeds sequentially: the motor 334 that is established in the interior of the upper shelf 10 rotates, the disk 333 rotates, the roller 332 that is attached eccentrically to the disk 333 rotates as a state of being inserted into the horizontal slot 331*a*, the roller 332 slides along the horizontal slot 331*a*, the upper frame 331 moves downwards, a pair of vertical moving bars 32 attached to the sides of the upper frame 331 and the horizontal anchor bars 31 horizontally attached to the vertical moving bars 32 simultaneously move downwards, and the horizontal separation bump 34 which is horizontally attached to the tip of the horizontal anchor bars 31 moves downwards simultaneously.

The horizontal anchor bars 31 and horizontal separation bump 34 are in close contact with the upper surface and the front of the horizontally arrayed tablet cassettes 22 while being moved down as a whole, and then vertical or horizontal separation of the tablet cassettes 22 from the cassette stands

21 is prohibited because the tablet cassettes 22 may not be manually lifted up or horizontally separated.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A semi-automatic medicine packaging machine comprises:

i) a medication feed outlet that feeds and outlets medications into a hopper;

ii) a manual dispensing tray;

iii) a sealing unit that seals medications in the hopper by medication envelope(s);

iv) a printing unit that prints data on the medication envelope(s);

v) a controller that controls the medication feed outlet, the printing unit, and the sealing unit;

vi) a button operation unit that inputs user's operation to the controller;

vii) a shelf that has an outlet connected to the hopper;

viii) an automatic supply unit, which discharges medications into the outlet according to the operation of the controller, comprising a plurality of cassette stands arrayed in the interior of the shelf and a plurality of tablet cassettes detachably established on the upper part of the cassette stands for housing medications; and ix) a cassette lock unit that is established on the shelf and prevents separation of the tablet cassettes from the cassette stands according to operation of the button operation unit, wherein the cassette lock unit comprises:

a) one or more horizontal anchor bars established in the interior of the shelf along the upper faces of the horizontally arrayed tablet cassettes;

b) one or more vertical moving bars that are established as vertically movable in the interior of the shelf and are vertically attached to the sides of the horizontal anchor bars; and c) a lift driver that is controlled by the controller and makes the vertical moving bars vertically moved by the horizontal anchor bars' having close contact with the upper surfaces of the tablet cassettes to prevent vertical separation of the tablet cassettes.

2. The semi-automatic medicine packaging machine of claim 1, wherein the cassette lock unit further comprises a horizontal separation bump attached to the horizontal anchor bar and being in close contact with the front faces of the tablet cassettes to prevent horizontal separation of the tablet cassettes.

3. The semi-automatic medicine packaging machine of claim 1, wherein the cassette lock unit further comprises a guide unit that is established in the interior of the shelf and guides vertical moving of the vertical moving bars.

4. The semi-automatic medicine packaging machine of claim 3, wherein the guide unit comprises:

a) one or more sliding tubes established on the vertical moving bars; and b) one or more vertical guide shafts inserted into the sliding tubes and have the upper and lower parts established in the interior of the shelf.

5. The semi-automatic medicine packaging machine of claim 1, wherein the lift driver comprises:

a) an upper frame that has a horizontal slot, wherein upper parts of the vertical moving bars are attached to the sides of the upper frame;

b) a roller that is slidably inserted to the horizontal slot, a disk on which the roller is eccentrically attached; and c) a motor that is established on the shelf, controlled by the controller, and makes the disk rotate.

* * * * *